United States Patent [19]

Girardin

[11] Patent Number: 4,874,177

[45] Date of Patent: Oct. 17, 1989

[54] HORSE RACING GAME

[76] Inventor: Ronald E. Girardin, 67660 Paletero Rd., Cathedral City, Calif. 92234

[21] Appl. No.: 615,284

[22] Filed: May 30, 1984

[51] Int. Cl.[4] ..... A63F 3/00

[52] U.S. Cl. ..... 273/246

[58] Field of Search ..... 273/246

[56] References Cited

U.S. PATENT DOCUMENTS

| | | | |
|---|---|---|---|
| 1,797,742 | 3/1931 | Ward | 273/246 |
| 2,070,605 | 2/1937 | Leighton | 273/246 |
| 3,057,623 | 10/1962 | Barnes | 273/246 |
| 3,690,666 | 9/1972 | Seitz | 273/246 |
| 3,883,143 | 5/1975 | Kelley | 273/246 |

FOREIGN PATENT DOCUMENTS

| | | | |
|---|---|---|---|
| 253009 | 6/1926 | United Kingdom | 273/246 |

*Primary Examiner*—Edward M. Coven

*Assistant Examiner*—Benjamin Layno

*Attorney, Agent, or Firm*—Albert L. Gabriel

[57] ABSTRACT

A horse racing game comprising a gameboard inscribed with the representation of a racetrack, a number of horse performance cards bearing personal information regarding actual horses, and a number matrix referring to that horse's performance in an actual racing event, markers for use by the players in enacting on the gameboard their progress in the simulated racing game, random number generator means for use in combination with the numbers matrix provided on the horse performance card in order to determine movement of the player's markers, tables by which the variable conditions of an actual horse racing event may be taken into account while running the simulated race, and a realistic race record for charting the progress and outcome of the simulated horse race.

36 Claims, 8 Drawing Sheets

62
FURLONGS TO MILES
ONE FURLONG----------ONE EIGHTH MILE
TWO FURLONG----------ONE FOURTH MILE
FOUR FURLONG----------ONE HALF MILE
EIGHT FURLONG----------ONE MILE
FIG. 2
64
DIVISION OF PURSES
FIRST PLACE----------60%
SECOND PLACE----------22%
THIRD PLACE----------12%
FOURTH PLACE----------6%
FIG. 3
FIG. 4
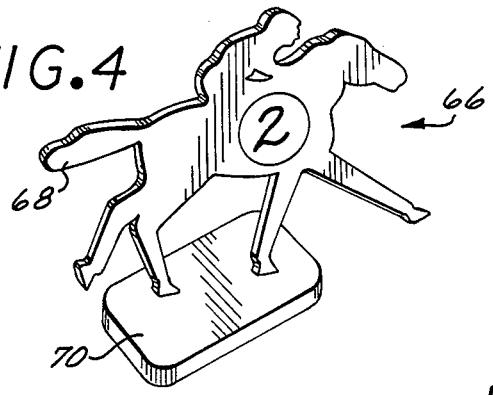
FIG. 5
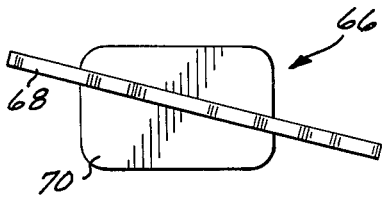
FIG. 6
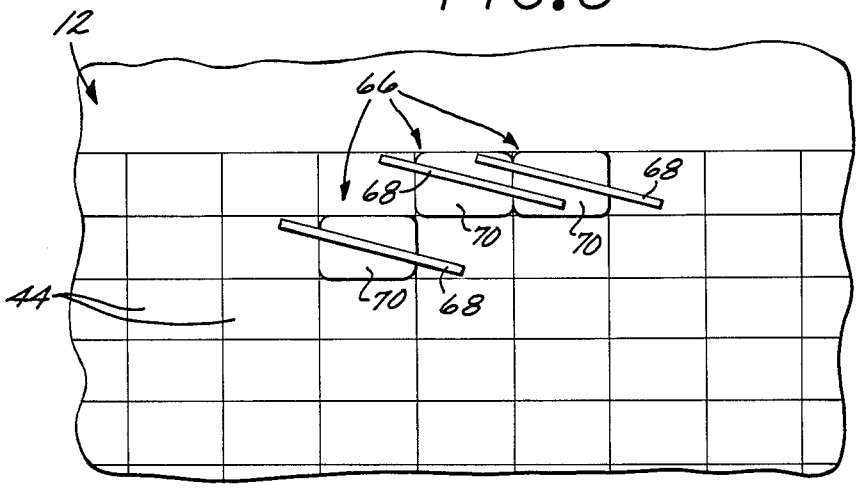

FIG. 7
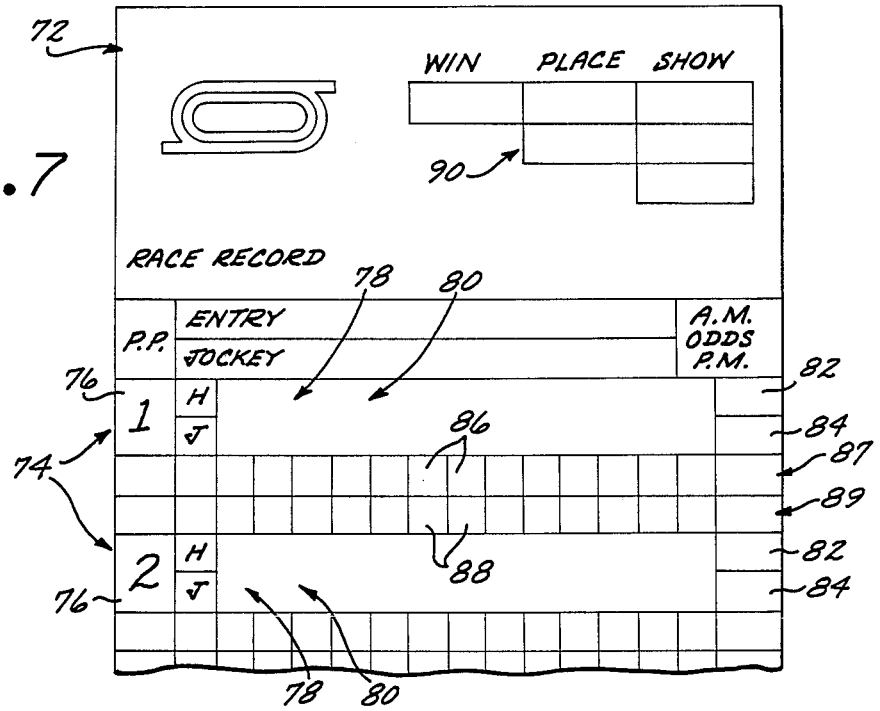
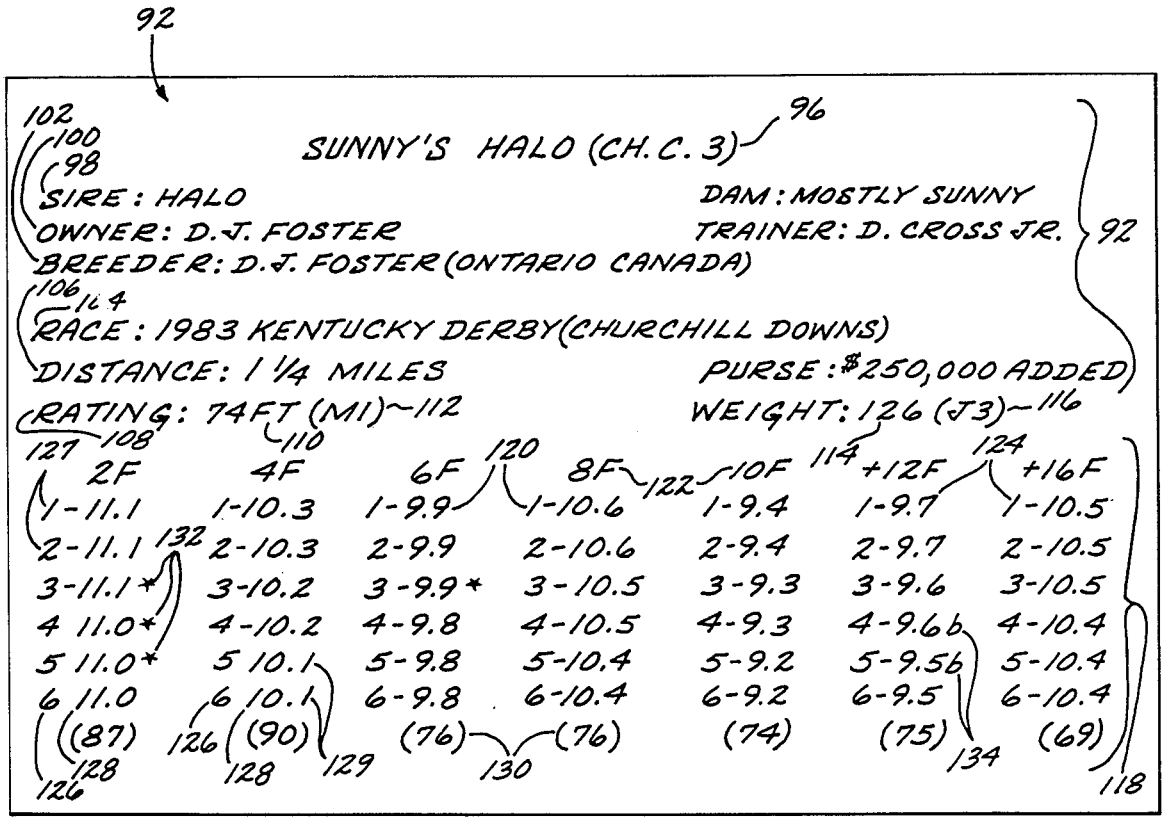
FIG. 8

136

TOTE BOARD

TABLE ONE

TRACK CONDITIONS (ADJUSTMENT PER FURLONG)

| MAIN (DIRT) TRACK | | TURF (GRASS) COURSE | |
|---|---|---|---|
| FAST | X | HARD | +.10 |
| GOOD | -.10 | FIRM | X |
| SLOPPY | -.20 | GOOD | -.30 |
| SLOW | -.30 | SOFT | -.60 |
| MUDDY | -.40 | YIELDING | -.70 |

140

HORSES GOING FROM DIRT TO GRASS: SUBTRACT .04 SPACES FROM EACH FURLONG TURN.
HORSES GOING FROM GRASS TO DIRT: SUBTRACT .06 SPACES FROM EACH FURLONG TURN

142

138

MUD MARKINGS
M0 = POOR MUDDER: NO CHANGE
M1 = FAIR MUDDER: +.20/F FOR ONE FURLONG
M2 = GOOD MUDDER: +.20/F FOR TWO FURLONGS
M3 = SUPERIOR MUDDER: +.20/F FOR THREE FURLONGS
THESE ADJUSTMENTS ARE USED WHEN THE TRACK CONDITIONS ARE OTHER THAN FAST OR FIRM.

144

TABLE TWO

HANDICAP ADJUSTMENTS

A. -.20/F FOR EACH POUND OVER WEIGHT
B. +.20/F FOR EACH POUND UNDER WEIGHT
C. NO CHANGE IF WEIGHT CARRIED IS UNALTERED
TOTAL FOR FIRST THREE FURLONGS AND BEGIN APPLYING WITH THE FOURTH FURLONG

146

TABLE THREE

JOCKEY ALLOWANCE

116
J1 NO CHANGE
J2 +.10 AROUND EACH TURN
J3 +.15 AROUND EACH TURN
J4 +.20 AROUND EACH TURN
J5 +.25 AROUND EACH TURN
J6 +.30 AROUND EACH TURN
APPLY AT THE FINISH ONLY

148

FIG. 9A

136

TABLE FOUR

RACING LUCK

134

A. BROKE SLOWLY (-.40)
B. STEADIED (-.10)
C. BUMPED (-.05)
D. CAME IN (-.05)
E. CAME OUT (-.15)
F. EASED OR PULLED UP
G. PULLED UP (NO PROGRESS)
H. HORSE UNSEATED RIDER
I. HORSE FELL (NO PROGRESS)
J. INQUIRY: DISALLOWED
K. DISQUALIFIED: DROP 1 PLACE
L. DISQUALIFIED: DROP 2 PLACES
M. DISQUALIFIED: PLACED LAST
* MAY PASS ONE HORSE WITHOUT CHANGING LANES

150

134

TABLE FIVE

LANE CHANGES

-.05 PEP LANE CHANGE

152

TABLE SIX

LOSS OF GROUND IN TURNS

| | |
|---|---|
| LANE 1 | NO LOSS |
| LANE 2 | 1 LENGTH |
| LANE 3 | 2 LENGTHS |
| LANE 4 | 4 LENGTHS |
| LANE 5 | 6 LENGTHS |
| LANE 6 | 8 LENGTHS |
| LANE 7 | 10 LENGTHS |
| LANE 8 | 12 LENGTHS |

154

TABLE SEVEN

MARGIN CHART

| | |
|---|---|
| .00 | DEAD HEAT |
| .01 | NOSE |
| .02 | HEAD |
| .03 TO .04 | NECK |
| .05 TO .09 | 1/4 LENGTH |
| .10 TO .14 | 1/2 LENGTH |
| .15 TO .19 | 3/4 LENGTH |
| .20 | ONE LENGTH |

156

FIG. 9B

136

TABLE EIGHT

TIME PER FURLONG CHART

| FURLONG | TIME | SPACES |
|---|---|---|
| 1 | :14 | 10 |
| 2 | :26 | 20 |
| 3 | :38 | 30 |
| 4 | :50 | 40 |
| 5 | 1:02 | 50 |
| 6 | 1:13 | 60 |
| 7 | 1:25 | 70 |
| 8 | 1:38 | 80 |
| 9 | 1:51 | 90 |
| 10 | 2:04 | 100 |
| 11 | 2:17 | 110 |
| 12 | 2:30 | 120 |
| 13 | 2:43 | 130 |
| 14 | 2:58 | 140 |
| 15 | 3:12 | 150 |
| 16 | 3:26 | 160 |

ALL TIMES ARE EXPRESSED IN MINUTES AND SECONDS.

158

TABLE NINE

PROJECTED COLUMN ADJUSTMENTS

| DISTANCES | DEDUCTIONS |
|---|---|
| 6½F TO 7F | 0.1 |
| 6½F TO 7½F | 0.2 |
| 6½F TO 8F | 0.3 |
| 7F TO 7½F | 0.1 |
| 7F TO 8F | 0.2 |
| 8½F TO 9F | 0.1 |
| 8½F TO 9½F | 0.2 |
| 8½F TO 10F | 0.3 |
| 9F TO 9½F | 0.1 |
| 9F TO 10F | 0.2 |
| 9½F TO 10F | 0.1 |
| 11F TO 12F | 0.2 |
| 14F TO 16F | 0.4 |

160

THIS TABLE IS USED ONLY TO ADJUST THE FORWARD PROGRESS OF A HORSE WHILE IT IS RUNNING IN A PROJECTED, (+), COLUMN THAT CONTAINS BOTH THE DISTANCE THE CARD IS BASED UPON AND ANY ADDITIONAL DISTANCE.

ABBREVIATIONS AND THEIR MEANINGS (X) TRACK CONDITIONS OF PERFORMANCE CARD.
(+) PLUS.
(-) MINUS.
(/F) PER FURLONG

162

FIG. 9C

164

166 168 TIME ADJUSTMENT TABLE

| +OR- DIFF | +OR- TIME | +OR- DIFF | +OR- TIME | +OR- DIFF | +OR- TIME |
|---|---|---|---|---|---|
| .20 | 1/5 | 3.20 | 3 1/5 | 6.20 | 6 1/5 |
| .40 | 2/5 | 3.40 | 3 2/5 | 6.40 | 6 2/5 |
| .60 | 3/5 | 3.60 | 3 3/5 | 6.60 | 6 3/5 |
| 2.80 | 2 4/5 | 5.80 | 5 4/5 | 8.80 | 8 4/5 |
| 3.00 | 3SEC. | 6.00 | 6SEC. | 9.00 | 9SEC. |

FIG. 10

172

WINNING ODDS AND PAYOFF CHART

| +OR- | NUMBERS OF HORSES IN THE RACE | | | | | | ODD-PAYS | |
|---|---|---|---|---|---|---|---|---|
| 174 | | | | | | | | 180 |
| +2 | $2.10 | $2.20 | $2.40 | $2.60 | $2.80 | $3. | 1-9 | $2.10 |
| +1 | $4.00 | $4.20 | $4.40 | $4.60 | $4.80 | $5. | 1-5 | $2.40 |
| 0 | $6.00 | $6.20 | $6.40 | $6.60 | $6.80 | $7. | 2-5 | $2.80 |
| -21 | $182. | $184. | $186. | $188. | $190. | $192. | 20-1 | $42.00 |
| -22 | $202. | $204. | $206. | $208. | $210. | $212. | 99-1 | $200.00 |

176 178

FIG. 11

184 182

PLACE PAYOFFS (9-2 OR LESS)

COMBINED ODDS OF FIRST TWO:

10-1 OR LESS 186

| | | | |
|---|---|---|---|
| 1- | $ NONE | 7- | $ 4.00 |
| 2- | $ 2.40 | 8- | $ 4.20 |
| 3- | $ 2.80 190 | 9- | $ 4.60 190 |
| 4- | $ 3.00 | 10- | $ 4.80 |
| 5- | $ 3.20 | 11- | $ 5.20 |
| 6- | $ 3.60 188 | 12- | $ 5.40 188 |

FIG. 12

194 192

SHOW PAYOFFS (9-2 OR LESS)

COMBINED ODDS OF FIRST THREE 10-1 OR LESS 196

| | | | | | |
|---|---|---|---|---|---|
| 1- | $ NONE | 7- | $ 2.40 | 13- | $ 3.00 |
| 2- | $ NONE | 8- | $ 2.40 | 14- | $ 3.20 |
| 3- | $ 2.10 | 9- | $ 2.60 | 15- | $ 3.40 |
| 4- | $ 2.20 | 10- | $ 2.60 | 16- | $ 3.60 |
| 5- | $ 2.20 200 | 11- | $ 2.80 | 17- | $ 3.60 200 |
| 6- | $ 2.20 198 | 12- | $ 2.80 | 18- | $ 3.80 |

FIG. 13

DAILY DOUBLE PAYOFF TABLES 202

COMBINED ODDS: 9-2 OR LESS 204

| | | | |
|---|---|---|---|
| 1-$ NONE | 4-$ 13.20 | 7-$ 18.40 | 10-$ 23.80 |
| 2-$ 9.40 | 5-$ 14.80 | 8-$ 20.20 | 11-$ 25.60 |
| 3-$ 11.20 | 6-$ 16.60 | 9-$ 22.00 | 12-$ 27.40 |
| 206 | 208 | 206 | 208 |

FIG. 14

EXACTA PAYOFF TABLES 210

COMBINED ODDS: 9-2 OR LESS 212

| | | | |
|---|---|---|---|
| 1-$ NONE | 4-$ 32.00 | 7-$ 47.50 | 10-$ 70.00 |
| 2-$ 24.00 | 5-$ 36.50 | 8-$ 52.00 | 11-$ 81.50 |
| 3-$ 29.50 | 6-$ 41.00 | 9-$ 63.50 | 12-$ 108.00 |
| 214 | 216 | 214 | 216 |

FIG. 15

PIC-SIX PAYOFF TABLE 218

| TOTAL | GRAND PRIZE | CONSOLATION |
|---|---|---|
| 1 | $ NONE | $ NONE |
| 2 | $ NONE | $ NONE |
| 3 | $ NONE | $ NONE |
| 4 | $ NONE | $ NONE |
| 5 | $ NONE | $ NONE |
| 6 | $ 75,000 | $ 25,000 |
| 17 | $ 157,500 | $ 52,500 |
| 18 | $ 165,000 | $ 55,000 |
| 35 | $ 292,500 | $ 97,500 |
| 36 | $ 300,000 | $ 100,000 |

220 222 224

FIG. 16

HORSE RACING GAME

BACKGROUND OF THE INVENTION

1. Field of the Invention

The invention relates to horse racing games in general, and more specifically to the components of a horse racing game utilized in combination to simulate horse races based on actual racing events.

2. Description of the Prior Art

For the playing of simulated horse racing games, various types of game boards, cards defining race conditions, horse markers that are moved along a game board, and random number generators have been used. It is typical in this type of game that the interpretation of the random number generators has no real bearing on actual horse performance and are therefore not realistic representations of an actual horse race. In addition, game boards are known wherein special squares are marked off along the game board featuring a simulated racetrack such that if a player's marker representing a horse lands thereupon, advancement of the marker is adjusted or forfeited. Again, the exigencies of this type of simulation are too random to be realistic.

The only attempt to produce a realistic simulated horse racing game known by applicant is represented by U.S. Pat. No. 3,690,666. The failure of this effort and of the combination of its components to create an interesting, realistic representation of a horse race lies in its complexity, inflexibility and the length of time it requires to play. In this prior art game, play is greatly complicated by the use of a race action board device. In order to utilize this device, a random number generator must first be used to determine conditions of the game which in turn correspond to numerical representations which require further computation in order to determine how each player must interpret the board, and then on each move each player must use a random number generator to interpret a horse performance card, which is then in turn used, in combination with the previous calculations, to interpret the board, which then ultimately determines the distance which a player may advance his or her marker along a board. This procedure is unnecessarily and undesirably complicated. The prior art game allows for no pregame strategy, focusing solely on the strategy of lane changing during the running of a simulated race. The simulated wagering possibilities generated by the prior art game are extremely limited and depend upon the utilization of random number generators to an unnecessary extent, thereby increasing the randomness of the odds and decreasing the realism. The race performance is indicated on the horse performance cards are non-race specific and are thereby of no interest of themselves, and since they relate to no specific historic event, are capable of varying rather widely.

While conditonal variables exist in the prior art game in order to simulate a realistic horse race, these variables are left too much to chance. They are also unavoidable. In order to run a simulated race with the prior art game, it is necessary to calculate by means of numerous random number generator selections track conditions, mud ratings and so forth for the race to be simulated, greatly increasing time of play. Additionally, although the prior art game in question has no randomly marked squares on its gameboard affecting play, there are randomly starred numbers on the race action board device which are then interpreted by a random number generator in a way that is not confined to the constraints of a realistic horse performance.

Applicant is aware of no simulated horse racing game that is both interesting and realistic, relates to historic events, and may be played in either a simplified convenient form or in an advanced, hyper-realistic form.

SUMMARY OF THE INVENTION

In view of these and other problems in the art, it is therefore a general object of the present invention to provide a horse racing game which is realistic without being unnecessarily complicated.

It is another object of the invention to provide a horse racing game of the character described which may be played in either a simplified, shortened version or an advanced, extended hyper-realistic version.

It is another object of the present invention to provide a horse racing game of the character described wherein the simplest version of the game simulates a faithful reenactment of an actual historical racing event.

Another object of the present invention to provide a horse racing game of the character described wherein the simplest version of the game requires no knowledge of racing strategy utilized either prior to or during the running of the simulated race.

It is another object of the present invention to provide a horse racing game of the character described wherein the simplest version of the game requires no pregame calculations in order to run a simulated race.

It is another object of the invention to provide a horse racing game of the character described wherein independent variables from the advanced version of the game may be added to the simplified version of the game in order to tailor the horse racing game to the needs and interests of the players.

Yet another object of the invention is to provide a horse racing game of the character described wherein only one random number generation is required of each player per round of moves, thereby shortening time of play.

Another object of the invention is to provide a horse racing game of the character described wherein only one random number generation is required per player per move, yet which takes into account all of the options, variables and exigencies of a realistic horse race situation.

Still another object of the invention is to provide equipment which realistically represents the difference between racing on an outer main or dirt track and racing on a inner turf or grass track.

A further object of the invention is to provide a horse racing game of the character described wherein only one matrix of numbers representing horse performance need be interpreted in order to establish the distance a player may advance for a given move.

A further object of the invention is to provide a horse racing game of the character described wherein the matrix of numbers which must be interpreted in order to determine the distance the players move refer to the events of an actual historical race.

It is a still further object of the invention to provide a horse racing game of the character described wherein the variation of performance left to chance on any given move is well within the reality of what might have been expected of a given horse in a given actual racing event.

It is yet another object of the invention to provide a horse racing game of the character described wherein prerace strategy is provided for as well as jockeying strategy during the simulated race.

Another object of the invention is to provide a horse racing game of the character described wherein the simulation of a horse race is not confined to the logistical constraints of the gameboard in that the game provides the possibility, as in actual horse racing, of finding an opening between tightly-packed horses in order to advance the forward progress of a horse.

It is another object of the invention to provide a horse racing game of the character described wherein racing luck and racing accidents are realistic to the extent that they are conceivable within the constraints of what might have happened or actually did occur in a given historical racing event.

Another object of the invention is to provide a racing game of the character described wherein the performances of various horses from actual historical events may be combined in order to produce historically interesting and imaginative races.

Yet another object of the invention is to provide a horse racing game of the character described wherein entire historical racing events may be reenacted.

It is a still further object of the invention to provide a horse racing game of the character described wherein a horse race may be simulated within a manageably brief period of time.

Another object of the invention is to provide a horse racing game of the character described wherein the involvement of the players and realism of the game are enhanced by a group of individuals who enjoy the game forming a "Racing Association" that includes various role players such as track secretary, track steward, track announcer, track starter, track statistician, track treasurer and cashier, and the like, who carry out specific roles during the course of the game.

Still another object of the invention is to provide a horse racing game of the character described wherein the realism of the game is enhanced by applying penalties, disqualifications and suspensions for fouls committed during the course of the game, such fouls occurring when players make moves that are not allowed under the rules of the game.

The horse racing game of the present invention comprises the use of a gameboard having a racetrack inscribed thereon consisting of two concentric, oval-shaped racetracks of eight lanes each, the outer racetrack representing a main or dirt track and the inner racetrack representing a grass or turf track. The track is marked along its length into a grid such that each square of the grid represents the distance of one-tenth of a furlong along a lane of the racetrack. The racetrack inscribed on the gameboard has a fixed finish line as in an actual race course and the race may begin at any point around the length of the track in order to facilitate races of varying lengths. Just beyond the finish line is a finish grid which, in combination with marking means, allows the players to visualize the relative finishes of their respective entries at the end of a simulated race. Side extensions are added to both the dirt and turf tracks in order to ensure that no race begins in a turn but begins on a straightaway as in actual horse racing. Distances from the finish line are marked by indicia inscribed on the race track in order to facilitate placement of a variable starting line and also to make following the progress of a simulated race easier.

Markers representing horse and rider combinations are provided which fit into the squares of the grid inscribed on the racetrack in order to mark a player's position, and color-coded dice are provided, one die for each marker. The dice and markers are paired and color coordinated.

Performances of actual horses in actual racing events are slightly randomized and reported on horse performance cards such that the random generation of a number by a roll of a die relates directly to a realistic performance of an actual horse in each furlong of a simulated race. Information about the horse and race from which the performance data are taken are included on the horse performance card. Horse performance cards are grouped together such that all the performance data for all the horses in a given historical racing event are grouped together. These racing packages are in turn grouped together into racing programs for 2-year olds, 3-year olds and "handicap stars" (3-year olds and up). A blank racing program is included such that the players may invent their own combination of horses to run an imaginary simulated race.

Means are provided for varying track conditions, weight assignments, jockey assignment, distance of race, and post position, all of which variables are brought to bear upon what might have been expected of a given horse in an actual racing event. Pregame racing strategy is provided for in that a distance running horse may be held back early in the race, or a sprinter horse may be pushed early in the race in order to gain position advantage, or a horse may be allowed to proceed according to its normal forward progress for its performance rating. Jockeying for position during the race is provided for and penalties are accorded those horses not jockeying carefully enough. Penalties are also accorded players whose prerace strategy fails.

Realistic racing luck options, such as finding an opening between horses or accidents or disqualifications, are included in the game, along with extensive simulated wagering possibilities. Odds may be determined before handicapping and jockey assignment as well as afterwards. Means are provided for determining the time of the simulated race. A realistic race record is provided in order to chart the progress of the race.

These and other objects of the present invention will become clear in the following description as taken in conjunction with the drawings.

BRIEF DESCRIPTION OF THE DRAWINGS

FIG. 2 is a conversion chart inscribed in area 2 on FIG. 1.

FIG. 3 is a horse racing purse analysis chart inscribed on the gameboard in area 3 in FIG. 1.

FIG. 4 is a perspective view of a horse racing game marker utilized on the gameboard in order to mark a player's position.

FIG. 5 is a view from above in elevation of the horse racing marker used in the horse racing game of the invention.

FIG. 6 is a fragmentary plan view from above illustrating a configuration of markers used in the horse racing game of the invention on the gameboard.

FIG. 7 is a portion of the race record utilized in charting the progress of a horse racing game as played per the invention.

FIG. 8 is a horse performance card having information inscribed thereon relating to personal data of the horse as well as to its performance in an historic racing event.

FIGS. 9A, 9B and 9C are portions of a tote board used in adjusting a player's moves according to conditions of the game and in visualizing the racing results.

FIG. 10 is a time adjustment table with portions broken away for use in establishing race times.

FIG. 11 is a winning odds and payoff chart with portions broken away for use in establishing odds and payoffs of winning horses.

FIG. 12 is a portion of a place payoff chart for use in establishing the payoff for place bets.

FIG. 13 is a portion of a show payoffs chart for use in establishing payoffs for show bets.

FIG. 14 is a portion of a daily double payoff chart for use in establishing daily double payoffs.

FIG. 15 is a portion of an exacta payoff chart for use in determining exacta payoffs.

FIG. 16 is a portion of a Pic-Six payoff chart for use in establishing Pic-Six payoffs.

DETAILED DESCRIPTION

Figure 1:
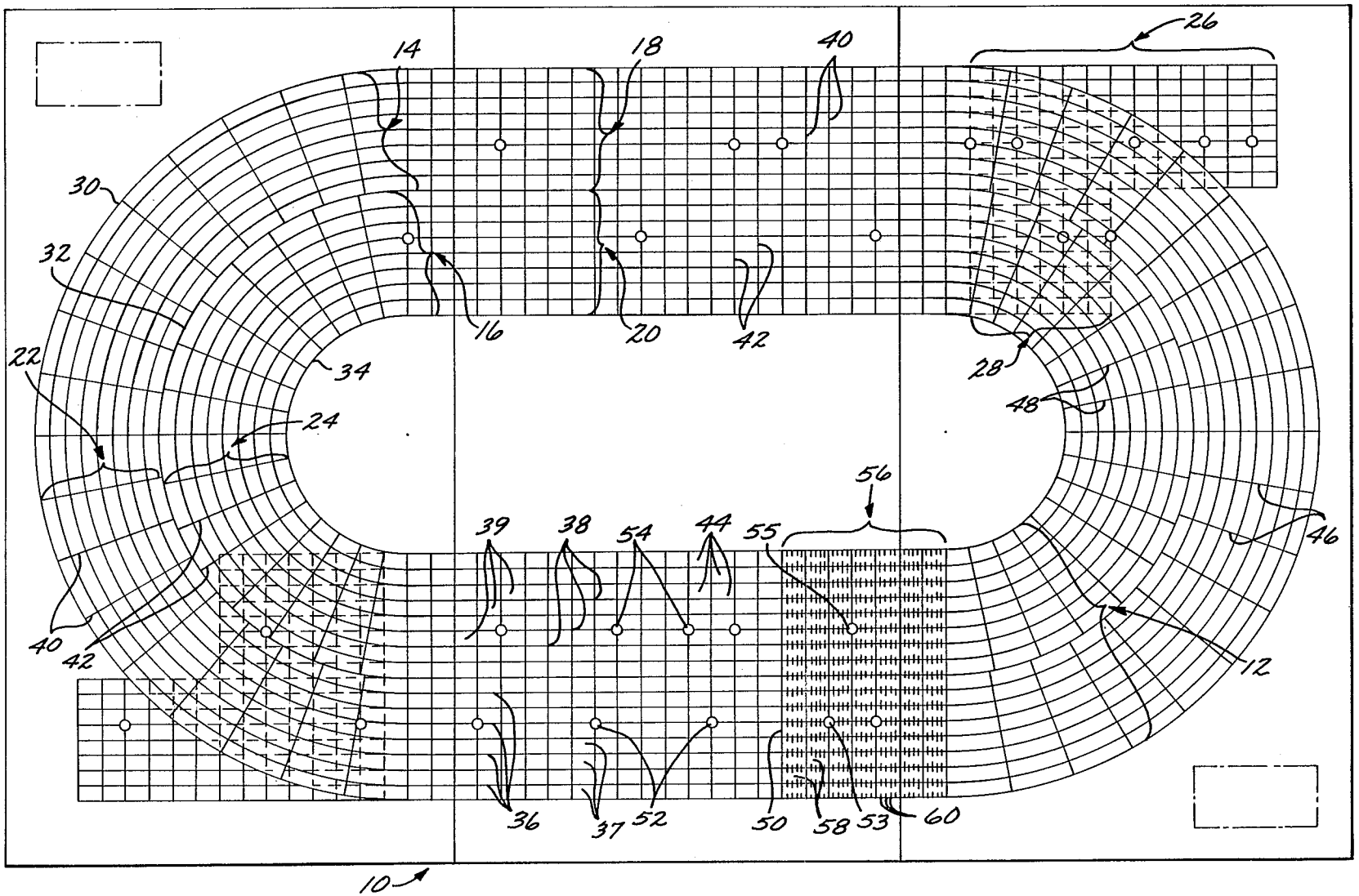
FIG. 1 is a plan view of a gameboard with a racetrack inscribed thereon.

Referring to the drawings and at first particularly to FIG. 1, the horse racing game of the present invention comprises in part a game board generally designated 10. Inscribed upon the game board 10 is a racetrack 12 consisting of two tracks—an outer dirt track 14 and an inner turf track 16.

Each of these tracks 14 and 16 are in a generally oval configuration and comprise parallel straightaways 18 and 20 corresponding to the dirt track 14 and the turf track 16, respectively. The parallel dirt straightaways 18 are joined by semicircular dirt turns 22 and the parallel turf straightaways 20 are joined by semicircular turf turns 24. In order to accommodate races of various lengths as on an actual racetrack, dirt course extensions 26 are added to the dirt straightaways 18 and turf course extensions 28 are added to the turf straightaways 20. The outer dirt track 14 is defined between the exterior oval fence line 30 and the oval track dividing line 32, whereas the inner turf track 16 is defined between the oval track dividing line 32 and the interior oval fence line 34.

Seven dirt lane lines 36 mark the outer dirt track 14 into eight dirt lanes 37. In like manner, seven turf lane lines 38 divide the inner turf track 16 into eight turf lanes 39. The dirt track 14 and turf track 16 are divided into a grid by the intersection of the dirt lane lines 36, with dirt radial marking lines 40 and by the intersection of the turf lane lines 38 with the turf radial marking lines 42. This intersection forms a grid of position squares 44, each position square 44 indicating a length of 1/10th of a furlong along a given lane. While the dirt radial marking lines 40 and the turf radial marking lines 42 are coextensive in the straightaway sections 18 and 20, they are not in the turn sections 22 and 24, since the dirt turn divisions 46 are more numerous than the turf turn divisions 48 in order to make visually apparent the difference between the distance covered in the semicircular dirt turns 22 and that covered in the semicircular turf turns 24.

A fixed finish line 50 is used in all races. Depending on the length of the race to be simulated the starting position of the race is moved back from the finish line 50 along the racetrack 12. The dirt course extensions 26 and the turf course extensions 28 are occasionally used at the start of a race to ensure that no race starts in a turn section. Dirt track furlong markers 52 and turf track furlong markers 54 indicate the distance around the dirt track 14 and the turf track 16, respectively, from the fixed finish line 50. Thus, the dirt track 8-furlong marker 53 indicates the position at which an 8-furlong dirt track race would start proceeding away from the finish line 50 around the dirt track 14 and ending at the finish line 50. The 7½-furlong marker 55 indicates the position at which a 7½-furlong turf race would start on the turf track 16 proceeding away from the finish line 50 around the turf track 16 and ending at the finish line 50. Just beyond the finish line 50 is the finish grid 56, defining a grid of finish position squares 58. At the finish of a race, the relative finishing position of entries may be visually represented down to a fifth of a position square 58, as marked by the placement calibrations 60.

Also inscribed on the gameboard 10 are two information charts as illustrated in FIGS. 2 and 3. A furlong-to-miles table 62 is inscribed on the gameboard 1 in order to make racing distances more readily comprehensible. A division of purses table 64 is inscribed on the gameboard 10 as an aid to simulated gambling and gambling strategy.

FIGS. 4–6 illustrate markers 66 for use in playing the horse racing game of the present invention. A horse and rider FIG. 68 is mounted on a marker base 70 in a diagonal configuration as illustrated in FIG. 5, such that the marker bases 70 may be kept small enough to fit precisely on a position square 44 while allowing the horse and rider FIG. 68 to be large enough to readily identify and grasp. The diagonal orientation of the FIG. 68 on the base 70 allows the markers 66 to be placed in close file. FIG. 6 shows one marker 66 directly behind another with no interference with the horse and rider FIG. 68.

FIG. 7 illustrates a race record to be used in charting the progress and results of simulated races. Inscribed on the race record 72 is a series of entry performance charts 74 for each of the entries. The entry performance charts 74 are marked by post position indicia 76 indicating the lane position of an entry at the start of a race. As indicated proximate the top of the race record 72, there are entry indicia 78, jockey indicia 80, a morning odds blank 82, and an afternoon odds blank 84. The bottom two lines of the entry performance chart 74 are a line of individual furlong performance blanks 86 and a line of summation furlong performance blanks 88. Successive sets of vertically paired blanks 86 and 88 in these two rows 87 and 89 are to be filled in following each move in the horse racing game of the present invention, since in the game each move corresponds to one furlong. The individual furlong performance blank 86 is to be filled out with the distance moved by the entry on a specific move, and the summation furlong performance blank 88 is to be filled with the total distance moved by the entry up to that point. Proximate the top of the race record 72 is a payoff chart 90 which may be filled out at the end of a simulated race with the win, place and show payoffs for the top three entries.

FIG. 8 illustrates a horse performance card 92 representing a historical horse and having inscribed information thereon relating to said horse. The horses represented by the performance cards 92 are the entries in the horse racing game. The top of the horse performance card is a personal section 94. The first line 96 of the personal section 94 of the horse performance card 92 indicates the horse's name followed by his color, gender and age. The next line 98 states the horse's sire and dam. This is followed on the next line 100 by the owner's name and the trainer's name. The next line 102 contains the breeder's name. The last three lines of the personal section 94 are race specific, and refer to the race from which the performance information inscribed on the performance card is taken. The first of these lines 104 indicates the year and the name of the race, including the name of the track whereon the race was run. The following line 106 indicates both the distance of the race and the value of the purse offered. The final line 108 of the personal section 94 indicates the horse racing game's performance rating 110 of the horse at the given distance, followed by the horse's mud rating 112. The weight carried 114 by the horse appears on line 108, followed by the horse racing game's rating 116 for the jockey who was aboard the horse.

The bottom half of the horse performance card 92 is inscribed with a numbers matrix which defines a performance section 118. The performance section 118 is divided into performance columns 120, indicating the horse's performance during any given quarter mile of the simulated race. At the top of the performance columns 120 are quarter mile indicia 122, indicating the quarter mile of the simulated race to which the given performance column 120 relates Any performance column 120 having a plus sign preceding its quarter mile index 122 indicates that that performance column 120 is a projected performance column 124. A projected column 124 is a column which in part or all represents a distance of ground in addition to the actual distance stated on the card for the race. Each performance column 122 is divided into a selector column 126 and a move column 128. The selector column 126 is numbered 1 through 6, and refers to the random selector numbers 127 generated by a random number generator such as a die. Corresponding to the selector column 126 is the move column 128. For any of the given numbers 127 in the selector column 126, a move number 129 in the move column 128 indicates the number of spaces a player's colored marker 66 may be moved.

Each of the performance columns 120 is used in two consecutive moves corresponding to two consecutive furlongs. For instance, the first performance column 120 is used in each of the first two furlongs, and each performance column 120 thereafter is used for successive pairs of furlongs. At the bottom of each performance column 120 is a quarter mile performance indicia 130, indicating the horse's performance rating for a race of the length indicated by the quarter mile indicia 122. Occasionally an asterisk 132 will appear after a move number 129 given in the move column 128 of a performance column 120. This is a passing asterisk 132 and indicates that the horse is allowed to pass another horse immediately in front of it without changing lanes. This is referred to as getting through or between horses or finding an opening, adding one of the contingencies of actual horse racing to the horse racing game of the present invention. Also following a move number 129 in a move column 128 may be a racing luck indicator 134, taking the form of a lower case letter. When a move number 129 in a move column 128 is followed by a lower case letter, it means that an unusual occurrence has happened during the simulated race. These racing luck indicators 134 add an element of chance to the horse racing game of the present invention in the form of actual racing luck. These elements of chance are preferably only included on performance cards 92 where they occurred in the actual historic event. The specific occurrence indicated by any given lower case letter may be found, along with other information, on the tote board 136, as it is illustrated in FIGS. 9A–9C.

The horse racing game of the present invention may include any desired number of the horse performance cards 92. Preferably, all of the horse performance cards that relate to a particular racing event are, for convenience of location, contained in a racing envelope (not shown) having the specific racing event identified on the outside thereof.

FIG. 9A shows the first three tables of the tote board 136. The track condition table 138 is actually composed of three smaller tables. The track condition move adjustment table 140 indicates the adjustment to be made on each furlong move if it is decided that the track condition for a given simulated race is to be other than fast for a dirt race, or firm for a turf race. The adjustments for these various track conditions are to be made with regard to the move number 129 indicated in the move column 128 on the horse performance card 92 for each move, since the move number 129 assumes that the race is being run on a fast or firm track. Beneath the track condition move adjustment table 140 is a track type adjustment table 142. This indicates the disadvantage that any given horse is at if he has been raced on or shows a preference for a turf track and has been moved to a dirt track, or vice versa. The penalties indicated in the track type adjustment table 142 are to be applied to each turn in the horse racing game. Beneath the track type adjustment table 142 is the mud rating adjustment table 144. This table refers to the mud rating indicia 112 on the horse performance card 92, and indicates the move adjustments to be made for a horse of a given mud rating if the track conditions are other than fast or firm after the adjustment indicated by the track condition move adjustment table 140 has been made.

Beneath the track condition table 138 is a handicap adjustment table 146, indicating the move adjustment to be made for a given horse carrying either more or less than its assigned weight. Such weight changes may be made in the horse racing game of the present invention in order to even the chances of winning between the entries. Beneath the handicap adjustment table is the jockey allowance table 148. The jockey allowance table 148 provides a system of adjusting the finish of a simulated race in accordance with the skill of the jockey assigned to a given horse. Included with the horse racing game of the present invention is a registry of actual jockeys; any given jockey from that registry may be assigned to a given horse. Notice that given in the handicap table 146 and the jockey allowance table 148 are numbers expressed as decimals. These numbers refer to adjustments to be made on the move numbers 129 dictating the progress of the entries. They also refer to adjustments in the performance rating derived from the performance indicia 130. To make the adjustments indicated, the following conversion applies: 0.2 of a move number 129 yields 0.2 of a position square 44 in adjusted distance or 1 horse length, which in turn yields an adjustment of 1 in the performance rating of the entry affected.

FIG. 9B illustrates the next four tables on the tote board 136. The racing luck table 150 states the meaning of the passing asterisks 132 and the racing luck indicators 134 which may occur in the move columns 128 of the performance section 118 of the horse performance card 92. Along with the meaning of the race indicators 134 are necessary move adjustments if applicable, race terminations, or finishing adjustments. Below the racing luck table 150 is a lane change adjustment table 152, indicating the distance adjustment to be made on any move including a lane change. Below the lane change adjustment table 152 is the turn adjustment table 154 which indicates the penalty in terms of position that a horse may expect to pay for riding in an outside lane during a turn. Naturally, the farther the horse is from the inner rail of the track, the farther it will have to run and the greater the loss of ground will be. Below the turn adjustment table 154 is the margin chart 156 which may be used to help visualize the finish of a very close race. The numbers in the margin chart 156 refer to the difference in total distance moved at the end of a race between any two horses. This total may be found in the final summation furlong performance blank 88 on a race record 72 filled out for a given entry in a given simulated race.

Standardized times for a race of a given length are to be found on the racing time table 158 illustrated in FIG. 9C. This table 158 indicates for any given number of furlongs the standard time a horse takes to cover that distance and the number of position squares 44 on the gameboard 10 relates to that distance. If a horse is running a race long enough to utilize the projected performance columns 124 on the horse performance card 92, the projected column adjustment table 160 must be used. Since some horses are sprinters and some are long distance runners, it is conceivable that a horse may be overextended by running a long race. Once a simulated race moves into a projected column 124 for a given horse, the player refers to the projected column adjustment table 160 to the line indicating at what point in the race projection has begun and begins to deduct from the horse's moves accordingly. This is only required in a projected column 124 containing the actual distance of the historic event and an additional distance. The projected column adjustment table 160 takes into account numerous likely racing distances, such as 7½ furlongs, 9 furlongs, 9½ furlongs, which are not included on the performance section 118 of the horse performance card 92 in order to facilitate move adjustment.

Thus, horses which travel or race a distance of ground with projected columns 124 of their respective performance cards 92 that are farther than the distances of the races their performance cards 92 are based upon are "slowed" or penalized for that additional ground because they tire at the end of the race. Conversely, horses running less than the distances of the races their respective performance cards 92 are based upon are "speeded up." The manner in which this is accomplished will appear in the note section of the time adjustment table 164 on the reverse side of tote board 136, which will read substantially as follows:

> If a horse runs in a simulated race that is at a shorter distance than its performance card [92] is based upon, then add 0.2 position square [44] (one length) beginning with the first furlong and continuing for as many additional successive furlongs as the difference is between the distance on the performance card [92] and the distance of the new race. For example, if the distance of the race specified on performance card [92] is 9 furlongs, and the new race is 6 furlongs, then 0.2 position square [44] (one length) is to be added to the horse's performance in each of the first three furlongs of the race.

At the bottom of FIG. 9C there is illustrated an abbreviations list 162 which explains the meaning of symbols and abbreviations used throughout the printed material relating to the horse racing game of the present invention.

On the reverse of the tote board 136 is a time adjustment table 164, used in calculating the time a horse has taken to run a simulated race after the race is finished. The time adjustment table 164 is used in conjunction with the racing time table 158 illustrated in FIG. 9C, and provides deviations from the standardized times listed in the time table 158. Any horse finishing a simulated race is likely to have covered a number of position squares 44 differing from that shown as the standardized number of position squares 44 for a given number of furlongs after the last furlong move of the simulated race. This deviation may be found in the summation furlong performance deviation column 166 on the time adjustment table 164, which relates to a time deviation in the standard racing time deviation column 168. This time deviation may then be related to the standardized time given by the racing time table 158 in order to find the horse's finish time. Thus, distance performance for a fixed standard time is converted to time performance for a fixed distance.

Included with the horse racing game of the present invention is a tote book 170. The tote book 170 contains extensive information on the determination and handling of track conditions, mud ratings, handicapping and jockeys, odds, prerace strategy, fouls, inquiries, disqualifications and suspensions, wagering and payoffs, and suggestions on game play.

The realism of the horse racing game of the present invention is enhanced by applying penalties, disqualifications and suspensions for fouls committed during the course of the game. Preferably, specific penalties for fouls, and specific grounds for disqualifications and suspensions, are provided in the tote book 170. Examples of specific fouls and penalties that may be provided are (1) a foul is committed where the forward progress of one horse is hindered by another horse "passing through it" while changing lanes to go outside or to the right; the fouled horse will lose half a length (0.10 of a position square 44). (2) Changing lanes to go to the inside or to the left constitutes a foul for which the fouled horse will lose one length (0.20 of a position square 44). (3) "Running over" another horse in the same lane constitutes a foul for which the fouled horse will lose two lengths (0.40 of a position square 44).

A horse committing a foul can be partially disqualified by being lowered one or more places in the final result of a race, or completely disqualified by being placed last in the final result of the race, if (1) a foul results in the order of finish for the first four finishers being changed; (2) if a foul was committed by a horse changing lanes to go outside or to the right; (3) if a foul was committed by a horse changing lanes to go inside or to the left; or (4) if a foul was committed by a horse "running over" another horse in the same lane. The most serious foul is "running over" another horse in the same lane, and for such a foul a jockey may be suspended for a particular number of racing days or a particular number of races. Such disqualification or suspension depends upon another player, usually the one that has been fouled, observing the occurrence of the foul and calling it out; and then the penalty of partial disqualification, complete disqualification or suspension is applied at the end of the race.

FIGS. 11–16 illustrate various odds and payoff charts included in the tote book 170. FIG. 10 illustrates the winning odds in payoff chart 172. The odds on an entry winning and its potential payoff may be found in this chart 172 by comparing the performance ratings of the entries found on their horse performance cards 92 on the last line 108 of the personal section 94. To find the favorite's odds, the top two performance ratings are compared and the difference found. For the favorite, the difference will be a positive number, which may be found in the performance rating difference column 174 of the winning odds and payoff chart 172. The potential payoff of a favorite is found by relating that difference to the corresponding monetary figure found in the payoff column 176 relating to the number of horses to be entered in the simulated race. The odds of the horse winning are found on the same line as the performance rating difference in the odds column 178. The performance rating of all other horses is compared to that of the favorite, the difference in their performance ratings being a negative number, which may be found in the performance rating difference column 174. In the case of co-favorites the performance rating difference is zero. The odds on any entry winning and its potential payoff may be found in the winning odds and payoff chart 172 in a manner similar to that described for the favorite.

FIG. 12 illustrates one of a plurality of place payoff charts 182 also included in the tote book 170. In order to determine the place payoffs for the first and second place horses in a given simulated horserace, the players find the place playoff chart 182 which lists a winning odds 184 corresponding to that of the first place horse, thereafter determining the chart which corresponds to the combined odds 186 of the first and second place horses. The odds of the first and second place horses are combined by finding their winning odds in the winning odds and payoff chart 172, transforming them into fractions having common denominators and adding them together. Once the proper place payoff chart 182 has been found, a random number between 3 and 12 is generated, preferably in this case by use of two dice, one for each of the first and second place horses. This randomly generated number may be found in the random number columns 188 and corresponds to a monetary figure in the place payoff columns 190. The monetary figure gives the place payoff for the winning horse. The same procedure is then followed to determine the place payoff for the second place horse.

A similar procedure is followed in order to determine show payoffs. The proper chart is chosen from a plurality of show payoff charts 192 by finding the show payoff chart 192 having the proper winning odds 194 for the first place horse and the proper combined odds 196 for the top three finishers. In this case, a number from 3 to 18 is randomly generated, preferably by the toss of three dice, this random number found in the random number columns 198 which corresponds to a monetary figure in the show payoff columns 200. A number from 3 to 18 is randomly generated three times in order to determine the show payoffs for the top three finishers in order.

The daily double payoff charts 202 are utilized in much the same way as the place payoff charts 182 and the show payoff charts 192. The proper daily double payoff chart 202 lists a combined odds 204 corresponding to that of the combined odds of the first place finishers of the first and second races of any simulated day of racing. A number from 2 to 12 is randomly generated located in the random number columns 206 which corresponds to a monetary amount in the payoff columns 208.

In order to determine an exacta payoff, the exacta payoff charts 210 are utilized in the same way as the daily double payoff charts 202 by finding the exacta payoff chart 210 listing the same combined odds 212 as that of the combined odds of the first and second place finishing horses in any given simulated race, then randomly generating a number between 2 and 12, locating that number in the random number columns 214, and finding the payoff in the form of a monetary figure in the corresponding payoff column 216.

The final form of simulated wagering in the horse racing game of the present invention is Pic-Six wagering. The Pic-Six is a special feature of the daily racing program involving six races that are run back to back, usually the second through seventh races. One $2.00 wager allows an individual to select one horse in each of these six races to win. The winner of the Pic-Six is the player who selects (i.e., wagers on) the most winning horses in the Pic-Six races. Thus, if a single player is the only player who selects all six winners, then that player wins the Pic-Six grand prize. However, if two or more players select all six winners, then these players would share the grand prize. However, if no player selects all six winners, then the player(s) selecting the most winners would be the recipient(s) of the grand prize. The recipient(s) of the consolation prize would be the player(s) selecting (i.e., wagering on) the next most winners in the Pic-Six races.

The payoff for the Pic-Six is determined from the Pic-Six payoff table 218 illustrated in FIG. 16. The players whose horses are the actual winners of the six Pic Six races each randomly generate a number between 1 and 6, preferably through the roll of a die, and these six random numbers are added together to produce a total number from 6 to 36, and this total number is then located in the random number column 220 on the Pic-Six payoff table 218 of FIG. 16. Should one or more of the players have multiple winners, then such player or players would multiply the result of his or her die roll by the number of winners in determining the total number to be selected in the random number column 220. It is to be noted that determination of the number in column 220 is made by rolls of the dice by the winning players regardless of whether such players had a winning wagering selection in the Pic-Six. The grand prize payoff and consolation payoff are found in respective columns 222 and 224 on the same line as the total that was determined in the random number column 220.

Authentic or Simplified Method of Play

There are essentially two ways to play the horse racing game of the present invention. The simplified version is much easier to learn and takes much less time. The horse performance cards 92 indicating potential entries in a simulated race are derived from performance of an actual historic race, as described above. Horse performance cards 92 are included for all the entries in each of 27 historic races and are grouped together by their shared race. They are further grouped together into racing programs separated into 2-year old programs, 3-year old programs, and "handicap stars" (3-year olds and up) programs, since horses in actual racing are commonly grouped together by their age. Provided with these programs, there are previously prepared race records 72 for each of the historic races. The players may utilize post positions 1 through 8 corresponding to lanes 1 through 8, 37 or 39, as given by the previously prepared record 72, on either of the outer dirt track 14 or the inner turf track 16, respectively, as illustrated in FIG. 1. The players may alternately randomly select horse performance cards 92 from the group corresponding to the historic race to be simulated. These horse performance cards 92 represent entries in the historic race to be simulated and are assigned the post position previously determined for the given entry or that has been selected for the player by the prepared record 72. The position of the starting line is determined by the length of the historic race listed on the horse performance cards 92 and is set back that distance around the racetrack 12 from the finish line 50. Each player then selects a marker 66 and a corresponding random number generator capable of generating a random number from 1 to 6. Preferably this generator takes the form of a die, and preferably corresponds by color to the player's chosen marker 66. Each player's marker 66 is placed in its proper post position lane behind the starting line.

The race begins when the player in the innermost post position activates all the random number generators (rolls the dice). Each player notes the number from 1 to 6 thereby generated on the die or other random number generator corresponding to his or her marker 66, and finds that random number in the selector column 126 on the corresponding horse performance card 92 in the first performance column 120. This corresponds on the same line to a move number 129 in the move column 128 paired to the selector column 126. Then beginning with the player given the first post position, each player advances his marker 66 the proper amount of position squares 44 forward. Since all selector numbers 127 are generated at once, determination of move numbers 129 is very quickly accomplished. Tenths of a position square 44 indicated by the move number 129 are held in reserve until another full position square 44 has been accumulated. The progress of the entries are noted in their individual furlong performance blanks 86 on the race record 72. The randomly generated selector numbers 127 for each succeeding move are determined by players holding successive post positions. Each player takes his turn rolling the dice in this manner. Each performance column 120 is utilized twice, as described above, in order to relate to successive pairs of furlongs traversed by the entries As the simulated race progresses, players keep track of the sum progress of their entry in the summation furlong performance blanks 88 included in their horse performance charts 74 on the race record 72.

Simulated furlongs and partial furlongs are run in this manner and continue until each horse has completed advancing in the final furlong of the simulated race. When the final horse has advanced, the winner can be determined. The total of all the move numbers 129 registered for each horse is made, including partial or tenths of a position square 44. The horse with the largest total is the winner of the simulated race. Each horse's order of finish is determined by its individual total, which is to be found in the final summation furlong performance blank 88 corresponding to the horse. The time of the race can be determined by comparing the winning horse's total forward progress against the standard for the distance. The standard time for a given distance is found in the racing time table 158 illustrated in FIG. 9C. To provide the time of the race, one-fifth of a second is subtracted from the standard time for the race for each one-fifth of a position square 44 the winning horse is beyond the standard number of position squares 44 for the distance. To make this calculation easier, the time adjustment table 164 is provided, as illustrated in FIG. 10. The margin each horse is from the horse in front or behind it can be determined by comparing the number of position squares 44 or partial position squares 44 they are apart with the values in the margin chart 156, as illustrated in FIG. 9B. This ends the game play for the simplified version of the horse racing game of the present invention.

Advanced Method of Play

In the advanced method of play, each player choses his marker 66 and may draw a horse performance card 92 from any of the cards 92 provided in the game. In this method of game play, a race can be simulated which never actually took place, adding a good deal of uncertainty as to its outcome. It is suggested that horses indicated by the horse performance card 92 that ran on dirt in the actual race, and horses which ran on grass in the actual race indicated on the cards 92, remain on those types of tracks rather than racing on a different surface. If a horse that ran on one type of track is to be transferred to another type of track, the track type adjustment table section 142 of the track condition move adjustment table 140, as illustrated in FIG. 9A, must be consulted, and each move of that horse adjusted accordingly. The distance for the simulated race is now determined either randomly or by mutual consent of players. The purse or amount of money to be offered by simulation for the winning of the race as well as the distribution of that simulated purse must be determined. The weight that each horse designated by horse performance card 92 is to carry is now assigned. Guidelines for weight assignment are included in the tote book 170. Jockeys are then selected by each player for his given horse from the jockey registries included with the horse racing game. Each jockey is rated from J1 to J6. Guidelines for assigning jockeys are also included in the tote book 170. Once the weight and jockey each horse is to carry have been assigned, the handicap adjustment table 146 and the jockey allowance table 148, as illustrated in FIG. 9A, must be consulted in order to determine any move adjustments that must be made during the running of the simulated race. Post positions are then randomly assigned to the players and their corresponding horses indicated by their horse performance cards 92.

Odds for the race are now determined. Morning or "a.m." odds along with potential payoffs are determined by the differences in performance ratings for each of the horses at the distance that the simulated race is to be run, and by relating that difference to the winning odds and payoff chart 172 of FIG. 10 in the manner described above. The "a.m." odds for each horse are then entered in the "a.m." odds indicator 171 on the race record 72 of FIG. 7 in the appropriate entry performance chart 74. "P.m." odds are determined by adjusting a horse's performance rating for the distance to be run according to the weight assignment handicap and the jockey allowance. Total performance adjustments may be made by consulting the handicap adjustment table 146 and the jockey allowance table 148 on the tote board 136 of FIG. 9A and making a suggested post position adjustment. To make such post position adjustment, each horse's rating (except those in post positions 1 and 2) is decreased according to the number of lengths (0.20 of a position square 44) it would have to fall back in making the lane changes necessary to move over to the inside lanes of post positions 1 or 2. Thus, post positions 3 and 4 are decreased by one rating point, post positions 5 and 6 are decreased by two rating points, and post positions 7 and 8 are decreased by three rating points. These various adjustments are figured into the horse's basic performance rating for the distance to be run, either increasing or decreasing it. "P.m." odds are then determined in the same method as the "a.m." odds utilizing the adjusted performance ratings and entered in the "p.m." odds indicator 173.

The balance of the race record 72 can now be completed. The number of the race on a given simulated racing day is entered; the name of the simulated race, the amount of the simulated purse, the distance of the simulated race, the horses' names, the weight they will carry, and the jockeys' names may all be entered on the race record 72.

Prerace strategy can now be determined by each of the players. The horse racing game of the present invention allows a player to select one of three strategy options: (1) to push his horse hard in the early portion of the race in hopes of being in the lead; (2) to hold his horse back in the early portion of the race in order to increase its stamina at the end of the race; or (3) a "rated," play-it-safe alternative. Before beginning the advanced method of game play, each player must report his or her prerace strategy to the other players.

If a player decides to use strategy option (1) and press his horse in the early portion of a race, he may add an additional position square 44 (5 lengths) to his normal forward progress in the first quarter mile of the race but must hold the lead. If the horse employing this "go-for-the-lead" strategy is in front by a full position square 44 (5 lengths) when it reaches the final straightaway section 18 or 20 of the race, then the horse may keep that additional position square 44 (5 lengths) taken in the early part of the race. If the horse employing the "go-for-the-lead" strategy is in front by less than a full position square 44 but by more than one-half of a position square (2½ lengths) 44 when entering the final straightaway section 18 or 20 of the simulated race, then it must surrender the position square 44 (5 lengths) taken in the early part of the race during the next two moves of the simulated race. If the horse employing a "go-for-the-lead" strategy is in front by less than one-half a position square (2½ lengths) or not in front at all, then it will tire in the final portion of the simulated race and will forfeit one full position square 44 (5 lengths) during each of its next two turns.

If a player decides to use strategy option (2) and hold his horse back, he withholds the progress of his horse by 5 lengths or one position square 44 during the first quarter of a mile, this being done by advancing 2½ lengths or one-half position square 44 less than its normal forward progress in each of the first two furlongs, the first two dice rolls of the race. If then at the beginning of the final entry into a straightaway section 18 or 20 of the race the horse thus held back is less than 2½ lengths or one-half position square 44 behind the leader of the race, then the horse held back regains the position square 44 (5 lengths) it withheld in the early part of the race plus an additional position square 44 (5 lengths). One of these five lengths or full position square 44 will be added to its normal progress in each of its next two forward turns. If at the beginning of the final straightaway section 18 or 20 of the simulated race the horse held back is behind the leader by one-half a position square 44 (2½ lengths) but not behind by a full position square 44 (5 lengths), then the horse held back will regain the position square (5 lengths) withheld in the early part of the race but will reap no further benefits. If the horse held back in the early portion of the race by this strategy is behind the leader by a full position square 44 (5 lengths) or more, the horse employing this strategy does not regain the ground held back in the early portion of the race. For strategy option (2) to be successful, at least one of the players must choose to use the "go-for-the-lead" strategy option (1). If no player chooses strategy option (1), then any player electing the hold-back strategy (2) will automatically forfeit the full position square 44 (5 lengths) that had been held back, in the stretch, i.e., in the final straightaway section 18 or 20 of the simulated race.

Race strategy option (3), the "rated" option is for players who want to avoid a "speed duel" or the possibility of falling too far behind. In this strategy option, the horse proceeds according to its normal forward progress for its performance rating adjusted as described in detail hereinabove. This horse will advance according to its normal forward progress in the stretch run after it has reached the final straightaway section 18 or 20 of the race, and it will not have to forfeit any ground regardless of how far back of the leader it may be when it reaches the final straightaway section 18 or 20 of the race.

The final prerace option is simulated wagering. Wagering is conducted in the same manner as at any actual racetrack. The tote book 170 indicates the payoff results for $2.00 win, place, show, daily double, and Pic-Six selections, as well as for $5.00 exacta wagering, as illustrated in FIGS. 11–16.

Once the prerace preparation for the advanced method of play has been completed, post positions are randomly assigned to the players and game play begins in the same manner as in the simplified method of game play. It is important to note that the location of one's horse during a race played according to the advanced method is extremely important. If a horse runs extremely wide throughout a turn it will be at a great disadvantage. This may be avoided in the advanced method of play by changing lanes. In order to change lanes and save ground, a horse must advance one position square 44 forward before it can move one lane 37 or 39 closer to the inner rail 34. If more lanes 37 or 39 are desired to be changed, then one forward move of a position square 44 must proceed each change. A diagonal is not considered a safe lane change, and it can result in a jockey's suspension for careless riding. The tote book 170 contains information on fouls, suspensions and inquiries to be conducted regarding a simulated race. A horse can change as many lanes 37 or 39 in one turn as its forward progress allows, but it cannot pass through or over any horse that has already completed its current turn. Each lane change must also reflect a deduction of a half-length or 0.1 of a position square from the total possible position squares 44 that can be advanced in that turn. The number of lane changes that are going to be made in any turn is best decided before advancing one's horse. The proper deduction can then be made from the total the horse can advance forward.

In this advanced method of play, as the race begins there is a unique way in which the horses leave the gate. Three of the horses will break more alertly than the remainder of the entries, possibly compensating for a disadvantageous post position. The results of the first dice roll determine who has the early advantage. The three owners or jockeys with the lowest numbers appearing on their dice leave the starting gate ahead of the others, the lowest number moving first, followed by the second lowest number, and then by the third lowest number. Ties are decided by the lowest post position number having the advantage. The remainder of the horses leave the starting gate in post position order.

As the horses leave the starting gate and the players begin to jockey for position, players will immediately discover that another horse may already occupy a position square 44 he or she would like to occupy. Since only one horse can occupy the position square 44 at the same time, this will force a player to decide whether his or her horse is going to race outside of another horse or horses and possibly lose ground throughout a turn, or position his or her horse behind another horse. If the latter option is chosen, then that player may hold in reserve any position squares 44 that he or she were unable to use. The order for advancing after each dice roll is determined by the position order of each horse. Normally there will be two or more groups of horses formed after the horses have advanced from the starting gate. The horse with the highest total of forward progress in the first group is considered the leader. The leader will advance first at the next roll of dice, followed by the horse with the second highest total in the group, and so forth for each member of the first group. The same method of determining who advances first is used for all groups that follow the first group. Horses are only allowed to advance in whole position squares 44. Most of the time there will be a portion of a position square 44 expressed in tenths or hundredths left over and held in reserve. This portion is taken into account when deciding which horse in a certain group advances first. Whenever the total for two or more horses in the same group is exactly the same, then the horse nearest the interior rail 34 advances first, and so forth out from the rail for each horse with the same total. As soon as enough reserved portions of a position square 44 have been accumulated to total an additional position square 44, that space must be advanced. The only exceptions to this rule are if a horse is forced to change lanes in order to use reserve until the next furlong move, or if an owner or jockey's prerace strategy allows his or her horse to hold a certain number of advancing position squares 44 in reserve and this additional space does not exceed the number allowed held in reserve.

If handicapping by weight assignment is being used, then an adjustment must be made in the forward progress of each horse in each furlong. This adjustment is either positive or negative or nonexistent in cases where the horse carries the same weight as indicated on the horse performance card 92. This adjustment is determined by the handicap adjustment table 146 depending on the weight the horse is carrying in the simulated race.

If jockey ratings are being used, then an additional adjustment will be made in the final move of the simulated race in accordance with the jockey allowance table 148 illustrated in FIG. 9A.

Another factor which can influence the forward progress of any horse is its lane position while racing through a turn, represented by the semicircular turns 20 and 24 of the dirt track 14 and turf track 16, respectively. Lane changes are not allowed while in a turn. Therefore, it is important to position one's horse prior to entering a turn. Each lane 37 or 39 except the innermost loses ground around a turn. The further away from the inside rail 34 a horse must run throughout a turn, the more ground it will lose. The amount of lengths lost during a turn can be determined by noting the lane number a horse occupies as it enters a turn and then referring to the turn adjustment table 154 illustrated in FIG. 9B.

During game play a player may find that his horse performance card 92 dictates a move number 129 being followed by a racing luck indicator 134. The meanings of these racing luck indicators 134 are explained in the racing luck table 150 on the tote board 136, as illustrated in FIG. 9B. These move adjustments, accidents or disqualifications must be applied to the player's move. Some unique types of racing luck which may be appropriate for particular horses but which space did not permit to be included in the racing luck table 150 on tote board 136 will be listed at the bottom of the respective performance cards 92 representing the particular race entries to which such types of racing luck actually occurred.

At least one horse should reach or pass the finish line 50 after the final furlong roll of a race. The finish grid 56 immediately following the finish line 50 divides the finish position squares 58 into fifths of a position square 44 equivalent to one length by means of placement calibrations 60. These divisions allow the finish to take on a realistic appearance The markers are placed in the appropriate division. To be one placement calibration 60 past the finish line 50 means that a horse was one-fifth or more of a position square 44 past the finish line 50 after its final advance but less than two-fifths of a position square 44.

On rare occasions none of the horses will reach the finish line 50 after the final furlong roll. When this happens the players do not roll again. The leading horse is advanced to the finish line, the race is over, and the order of finish is recorded. In such an instance the time of the race will be greater than the standard time indicated on the racing time table 158, and adjustments will be made according to the time adjustment table 164 on the back of the tote board 136 by adding time to the standard time indicated on the racing time table 158 for the distance. One-fifth of a second is added to the standard time for the distance for each one-fifth of a position square 44 the winner falls short of the finish line 50.

Any one or more of the variables and options from the add method of play may be added to the authentic or simplified method of play, and can be added sequentially in order to facilitate learning the advanced method of play and to serve as a teaching means realistically leading novice players to an in-depth understanding of the running of an actual horse race.

The horse racing game of the present invention can be enhanced and made even more realistic by the use of "role playing." A group of individuals who enjoy the game can form a "Racing Association" which elects or appoints various officers or role players, which can include such roles as president, vice president, track secretary, track steward, track announcer, track starter, track statistician, track treasurer and cashier, and the like. The specific functions of each such role player are to be agreed upon by the Racing Association, examples of such functions being the track secretary having responsibility for assigning weight and the drawing of post position; the track steward being responsible for recording the progress of the race and presiding over inquiries; the track starter being responsible for rolling the dice for each turn or portion of a race; the track announcer being responsible for announcing the progress of the race; the track treasurer and cashier being responsible to account for all money transactions, such as the purchasing of horses, accepting entry fees, purse distribution, and the selling and cashing of wagering tickets; and the track statistician being responsible for collecting the results of all races and recording them in chart form. Such role playing may be employed in either the simplified method of play or the advanced method of play.

Referring again to the gameboard as illustrated in FIG. 1, a winner's circle 226 is located thereon proximate the conventional location relative to a real racetrack. When the final order of finish and the distance between horses has been determined, the winning player's horse is placed in the winner's circle, and if role playing is a part of the game that is being played, then the track announcer can inform all of the players of the winner's name. This represents a "prize" to younger players and is a symbol of prestige to older players who may choose to use the options described above for role playing. The winner's circle 226 may be thus utilized in either the simplified method of play or the advanced method of play.

Simulated race programs (not shown) may be included in the horse racing game of the present invention. Preferably there are three separate programs, one for 2-year olds, a second one for 3-year olds, and a third for the "handicap stars" (3-year olds and up). Preferably each of these programs contains the following information: (1) a listing of the ten leading money winners by horses, jockeys, trainers, owners, and breeders. These are real names of real horses, jockeys, and people or associations, and may be listed on one page of the program, preferably on the inside of the cover. (2) The next page may list the races, preferably nine in number, contained in that program including where they were run, what horses were the first three finishers, and the time and track conditions of that race. Preferably all nine races are actual races that were run in the same year. (3) The third page of the program preferably has aids which will assist in an understanding of the program and of the horse performance cards 72.

Then the following nine pages preferably list the nine races contained in the program, in order, by race number, the distance, the purse, the name of the race and what running it was (e.g., the 109th running of the Kentucky Derby), the actual division of the purse for the first four finishers, the best time the race was ever run or the stakes record, each horse entry's name, the jockey for each horse, the weight each horse actually carried, the actual odds for each horse at race time, with boxes provided for handicap allowances and jockey allowances should the advanced method of play be chosen, the "a.m." or morning odds being listed above the actual odds at race time, and at the bottom of each of these nine separate race pages a space for recording the time of the race (with or without the fractional times) and the track conditions. The final page within the program lists the jockey registry, and then on the inside of the back cover is a wagering record.

The horse racing game of the present invention provides a realistic simulation of an actual horse race or day of racing. In the simplified version of game play the game is quick and easy to learn. In the advanced version of game play the horse racing game of the present invention is as realistic as it can be made. All the variables influencing an actual horse race may be introduced into the advanced version of game play. The horse racing game of the present invention allows for prerace strategy and for strategy during the running of the race. The game allows for simulated wagering and provides extensive realistic wagering charts. Pains have been taken with the horse racing game of the present invention to minimize chance and randomness in the game to the degree that it exists in actual horse racing. The options present in the advanced version of game play, such as handicapping, jockey allowance, track condition, prerace strategy, etc., may be added one at a time to the simplified version of game play in order to create a desirable game or in order to facilitate learning.

While the present invention has been described with reference to presently preferred embodiments, it is to be understood that various modifications may be made by those skilled in the art without departing from the scope and spirit of the invention as set forth in the appended claims.

I claim:

1. A horse racing game comprising:

a gameboard bearing the representation of a racetrack divided into a plurality of lanes, said lanes being divided by a plurality of transversely extending lines dividing said racetrack into a grid of position squares marking fixed distances along said lanes, a plurality of moveable markers representing entries in a simulated race to be enacted on said gameboard, said markers being moveable around said represented racetrack in order to mark the progress of said entries during the running of said simulated race, random number generator means and, a plurality of horse performance cards, each of said cards bearing information regarding a potential said entry in said simulated race, said information including a numbers matrix comprising a selector column of selector numbers selectable according to numbers generated by said random number generator means, and a move column adjacent said selector column and containing a series of move numbers registering with respective said selector numbers, each of said move numbers directly indicating the distance in terms of said position squares that said marker corresponding to said horse performance card is to move about said represented racetrack on any given move, said numbers matrix inscribed on each of said horse performance cards representing the actual performance of a real horse in a real historical racing event.

2. A horse racing game as defined in claim 1 wherein said horse performance card includes information referring to said actual horse and said actual race from which said numbers matrix is derived.

3. A horse racing game as defined in claim 1 wherein said horse performance cards represent the actual horses which raced against each other in a real historical racing event, each of said horse performance cards representing the actual performance of that horse in said historical racing event, whereby said horse racing game may be used to faithfully reenact said historical racing event.

4. A horse racing game as defined in claim 1 wherein said random number generator means comprises a plurality of random number generators, each of said random number generators corresponding to one of said moveable markers.

5. A horse racing game as defined in claim 4 wherein all of said selector numbers necessary to determine said move numbers for one move for each of said entries in said simulated race may be generated at once by means of said plurality of said random number generators, thereby speeding up the running of said simulated race.

6. A horse racing game as defined in claim 4 wherein the first move at the start of a horse race is made by the said moveable marker which corresponds to the random number generator that generates the lowest number for that move.

7. A horse racing game as defined in claim 6 wherein the second and third moves at the start of said horse race are made by the respective said moveable markers which correspond to the random number generators that generate the second and third lowest numbers, respectively, for that move.

8. A horse racing game as defined in claim 1 wherein said represented racetrack is divided into two concentrically oriented racetracks representing different types of racing surfaces.

9. A horse racing game as defined in claim 1 wherein a handicapping table is included indicating adjustments to be made on said move numbers contingent on said handicapping by weight assignment of said entries, whereby said entries may be handicapped by the assignment of various weights.

10. A horse racing game as defined in claim 1 which comprises a jockey allowance table listing a plurality of actual jockeys and an adjustment of said move numbers corresponding to each of said jockeys, assignment of a particular said jockey to ride the horse of a particular said horse performance card indicating that the respective said adjustment for such jockey is to be applied to move numbers determined by said random number generator means for such horse performance card.

11. A horse racing game as defined in claim 10 which comprises three simulated programs, a first one for 2-year olds, a second one for 3-year olds, and a third one for 3-year olds and up, each of said programs containing nine race sheets which define nine respective actual historic races, each of said race sheets indicating the distance, the name of the race, the purse of the race, the first four divisions of the purse, each horse's name, each horse's jockey, each horse's weight carried, and each horse's actual odds at race time.

12. A horse racing game as defined in claim 1 which comprises a track condition table listing a plurality of different track conditions and an adjustment of said move numbers corresponding to each of said track conditions, assignment of a particular track condition indicating that the respective said adjustment is to be applied to said move numbers for each said entry.

13. A horse racing game as defined in claim 12, which comprises a mud rating adjustment table listing a plurality of mud ratings and an adjustment of said move numbers corresponding to each of said mud ratings, each of said horse performance cards having one of said mud ratings thereon, a track condition other than fast or firm indicating that the respective said mud rating adjustment on each of said horse performance cards is to be applied to said move numbers for a given series of moves of the respective said entry.

14. A horse racing game as defined in claim 1, which comprises a racing luck table listing a plurality of symbols corresponding to respective unusual occurrences which may occur and a racing luck adjustment of said move numbers corresponding to at least some of said symbols, a plurality of said horse performance cards each having at least one of said symbols registering with at least one of said move numbers on such card indicating that the respective racing luck adjustment is to be applied to said one move number, said racing luck symbols on said horse performance cards corresponding to specific unusual occurrences which occurred in said real historical racing event.

15. A horse racing game as defined in claim 1 wherein prerace strategy may be determined for each of said entries and then carried out during the running of said simulated race.

16. A horse racing game as defined in claim 15 wherein one such strategy is to hold back a given strategic entry by holding in reserve portions of the early move allotments of said entry as determined by said move numbers and then attempt to utilize those portions held in reserve in the latter part of the race.

17. A horse racing game as defined in claim 16 wherein toward the end of said simulated race for a given relation of said strategic entry utilizing said holding back strategy to the leader of said simulated race, said entry utilizing said strategy may regain said move portions held in reserve.

18. A horse racing game as defined in claim 17, wherein said entry utilizing said strategy may not only regain said move portions held in reserve but also a bonus move adjustment.

19. A horse racing game as defined in claim 16 wherein toward the end of a simulated race for a given unfavorable relation of said entry utilizing said holding back racing strategy to the leader of said simulated race, said entry utilizing said strategy may not regain said move portions held in reserve.

20. A horse racing game as defined in claim 15 wherein said pregame racing strategy includes the option of extending a given strategic entry in the early part of a simulated race a determinate portion beyond the progress alloted to said strategic entry by the corresponding move numbers, pushing said entry toward the lead in said simulated race early in said simulated race and then attempting to hold said strategic entry in the lead so as not to surrender said determinate extended move portion.

21. A horse racing game as defined in claim 20 wherein proximate the end of said race given a favorable relation of said strategic entry to the remainder of said entries in said race, said strategic entry does not have to surrender said determinate portion of said early moves which were extended beyond said corresponding move numbers.

22. A horse racing game as defined in claim 20 wherein proximate the end of said race for a given relation of said strategic entry to the remainder of the said entries in said race, said strategic entry has to surrender the extended portions of said early moves which went beyond said corresponding move numbers.

23. A horse racing game as defined in claim 22 wherein said strategic entry must not only surrender the extended portions of the early moves corresponding to said move numbers but must additionally surrender a penalty adjustment on the move numbers corresponding to said strategic entry's final moves in said simulated race.

24. A horse racing game as defined in claim 15 wherein said pregame racing strategy includes the option of a given strategic entry proceeding according to its normal forward progress allotted to said strategic entry by the corresponding move numbers.

25. A horse racing game as defined in claim 1 wherein said horse performance cards include a performance rating for a given entry represented by a given horse performance card, said performance rating representing the expected performance of said entry during said simulated race as derived from said numbers matrix.

26. A horse racing game as defined in claim 25 wherein a plurality of said performance ratings are incorporated in said horse performance card severally indicating the expected performance for said entry for races of varying distances.

27. A horse racing game as defined in claim 1 wherein said horse racing game includes a winning odds and payoff chart by means of which may be determined the odds that a given entry will win said simulated race and also given said winning odds, the payoff for a given entry upon winning said simulated race.

28. A horse racing game as defined in claim 27 wherein a place odds and payoff chart is included which in combination with said winning odds and payoff chart determines the payoff for a given entry placing second or better in said simulated race.

29. A horse racing game as defined in claim 27 wherein a show odds and payoff chart is included which in combination with the winning odds and payoff chart may be used to determine the payoff for a given entry placing third or better in said simulated race.

30. A horse racing game as defined in claim 27 wherein a daily double payoff chart is included by means of which in combination with said winning odds and payoff chart the payoff for the daily double on a given day of simulated racing may be determined.

31. A horse racing game as defined in claim 27 wherein an exacta payoff chart is included by means of which in combination with said winning odds and payoff chart the exacta payoff for a given simulated day of racing may be determined.

32. A horse racing game as defined in claim 1 wherein a Pic-Six payoff chart is included by means of which for a given six races the payoff for a Pic-Six winner may be determined.

33. A horse racing game as defined in claim 1 wherein said gameboard bears the representation of a winner's circle thereon.

34. A horse racing game as defined in claim 1 wherein players of the game perform respective functions of a plurality of functionaries at a real racetrack.

35. A horse racing game as defined in claim 1 wherein a violation of a rule of the game causes a foul to be committed, a forward progress penalty being applied to the respective said moveable marker upon which the foul was committed.

36. A horse racing game as defined in claim 35 wherein if such foul is detected as the game is being played, then a disqualification or suspension is applied to the moveable marker committing the foul at the end of the race.

* * * * *